US012168836B2

(12) United States Patent
Wagner et al.

(10) Patent No.: US 12,168,836 B2
(45) Date of Patent: Dec. 17, 2024

(54) METHOD FOR FORMING A CATHODIC PROTECTION COATING ON A TURBOMACHINE PART

(71) Applicants: CENTRE NATIONAL DE LA RECHERCHE SCIENTIFIQUE, Paris (FR); INSTITUT NATIONAL POLYTECHNIQUE DE TOULOUSE, Toulouse (FR); UNIVERSITE PAUL SABATIER-TOULOUSE III, Toulouse (FR); SAFRAN AIRCRAFT ENGINES, Paris (FR)

(72) Inventors: Julien Pierre Wagner, Moissy-Cramayel (FR); Léa Rébecca Gani, Moissy-Cramayel (FR); Stéphane Knittel, Moissy-Cramayel (FR); Florence Ansart, Moissy-Cramayel (FR); Pierre-Louis Taberna, Moissy-Cramayel (FR)

(73) Assignees: SAFRAN AIRCRAFT ENGINES, Paris (FR); CENTRE NATIONAL DE LA RECHERCHE SCIENTIFIQUE, Paris (FR); INSTITUT NATIONAL POLYTECHNIQUE DE TOULOUSE; UNIVERSITE PAUL SABATIER-TOULOUSE III

( * ) Notice: Subject to any disclaimer, the term of this patent is extended or adjusted under 35 U.S.C. 154(b) by 0 days.

(21) Appl. No.: 18/703,202

(22) PCT Filed: Oct. 21, 2022

(86) PCT No.: PCT/FR2022/051997
§ 371 (c)(1),
(2) Date: Apr. 19, 2024

(87) PCT Pub. No.: WO2023/073310
PCT Pub. Date: May 4, 2023

(65) Prior Publication Data

US 2024/0328025 A1 Oct. 3, 2024

(30) Foreign Application Priority Data

Oct. 26, 2021 (FR) ..... 2111343

(51) Int. Cl.
*C25D 13/02* (2006.01)
*C25D 13/14* (2006.01)
*C25D 13/22* (2006.01)

(52) U.S. Cl.
CPC ..... *C25D 13/02* (2013.01); *C25D 13/14* (2013.01); *C25D 13/22* (2013.01)

(58) Field of Classification Search
None
See application file for complete search history.

(56) References Cited

U.S. PATENT DOCUMENTS 3,787,305 A * 1/1974 Ballard ..... C25D 13/00 204/491
2014/0339085 A1* 11/2014 Bouyer ..... C25D 13/02 204/491

(Continued)

FOREIGN PATENT DOCUMENTS

CN 1743499 A 3/2006
CN 107034466 A 8/2017

(Continued)

OTHER PUBLICATIONS

Written Opinion of the International Searching Authority as issued in International Patent Application No. PCT/FR2022/051997, dated Feb. 16, 2023.

(Continued)

*Primary Examiner* — Louis J Rufo
(74) *Attorney, Agent, or Firm* — Pillsbury Winthrop Shaw Pittman LLP

(57) ABSTRACT

A method for forming a cathodic protection coating on a substrate forming a turbomachine part, includes deposition, on the substrate, of particles for cathodic protection of the substrate, this deposition being performed by electrophoresis from an organic electrolyte including the particles, and forming an inorganic matrix in pores of the deposit of particles produced in this way, including impregnating the deposit with an impregnation composition, drying heat treatment of the deposit impregnated by the impregnation composition, and densifying the deposit by mechanical compacting, after the drying heat treatment, in order to make the deposit electrically conductive.

12 Claims, 8 Drawing Sheets

(56) References Cited

U.S. PATENT DOCUMENTS

| | | | |
|---|---|---|---|
| 2017/0101716 | A1 | 4/2017 | Roth et al. |
| 2019/0256983 | A1 | 8/2019 | Joulia et al. |
| 2021/0172331 | A1 | 6/2021 | Le Biez et al. |

FOREIGN PATENT DOCUMENTS

| | | | |
|---|---|---|---|
| CN | 110035983 | A | 7/2019 |
| CN | 112601841 | A | 4/2021 |
| FR | 1 533 589 | A | 7/1968 |
| FR | 2 142 078 | A1 | 1/1973 |
| FR | 3 102 694 | A1 | 5/2021 |
| GB | 1181996 | A | 2/1970 |

OTHER PUBLICATIONS

International Search Report as issued in International Patent Application No. PCT/FR2022/051997, dated Feb. 16, 2023.

Guo, X., et al., "Ultra-low-voltage electrophoretic assembly of extremely water-repellent functional nano-AI films with long lifespan," Journal of Materials Science: Materials in Electronics, vol. 31, No. 16, Jul. 2020, XP037206551, pp. 13503-13510.

Dusoulier, L., et al., "$YBa_2Cu_3O_{7-x}$ dispersion in iodine acetone for electrophoretic deposition: Surface charging mechanism in a halogenated organic media," Journal of the European Ceramic Society (Year: 2011), vol. 31, pp. 1075-1086.

Office Action as issued in Chinese Patent Application No. 202280071880.4, dated Sep. 25, 2024.

* cited by examiner

[Fig. 1]
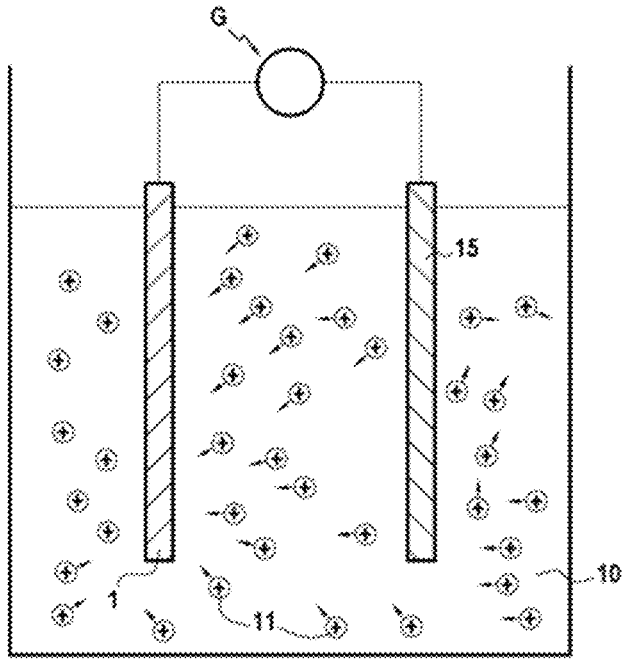
[Fig. 2]
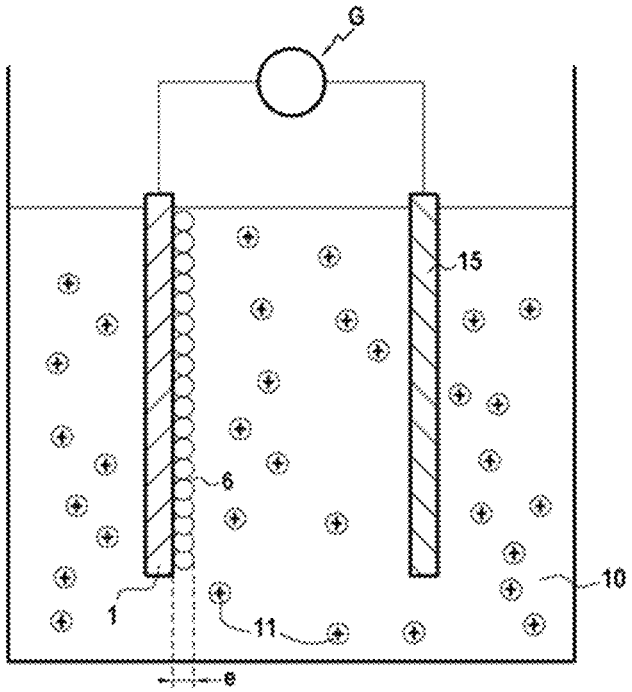

[Fig. 3]
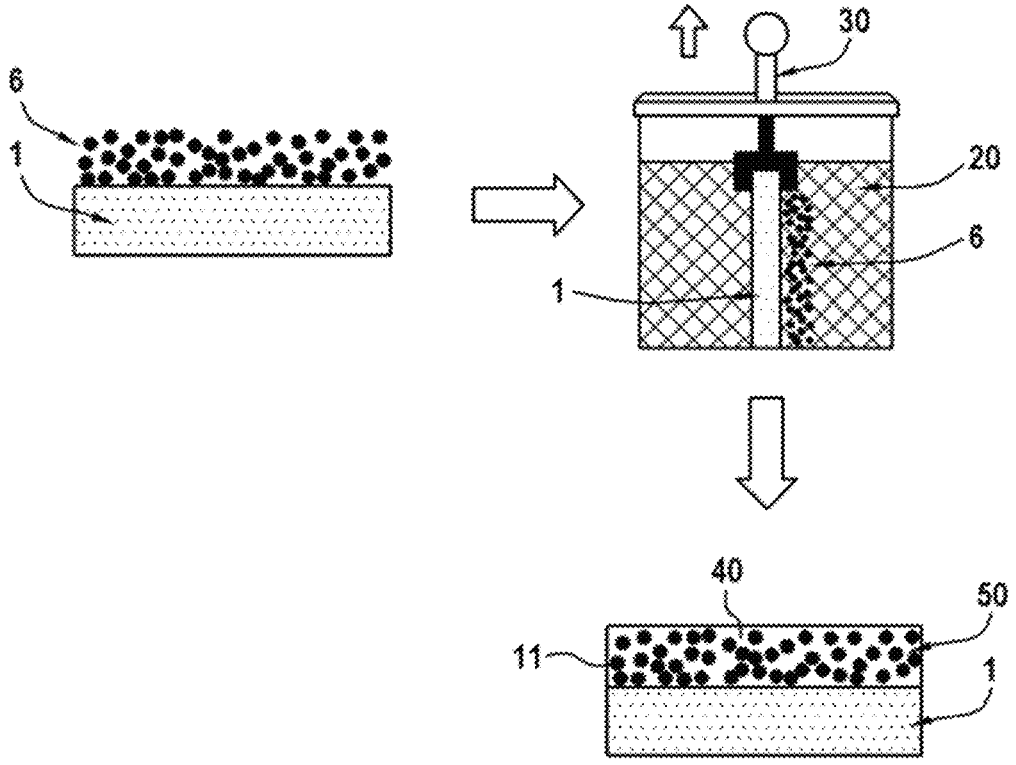
[Fig. 4]
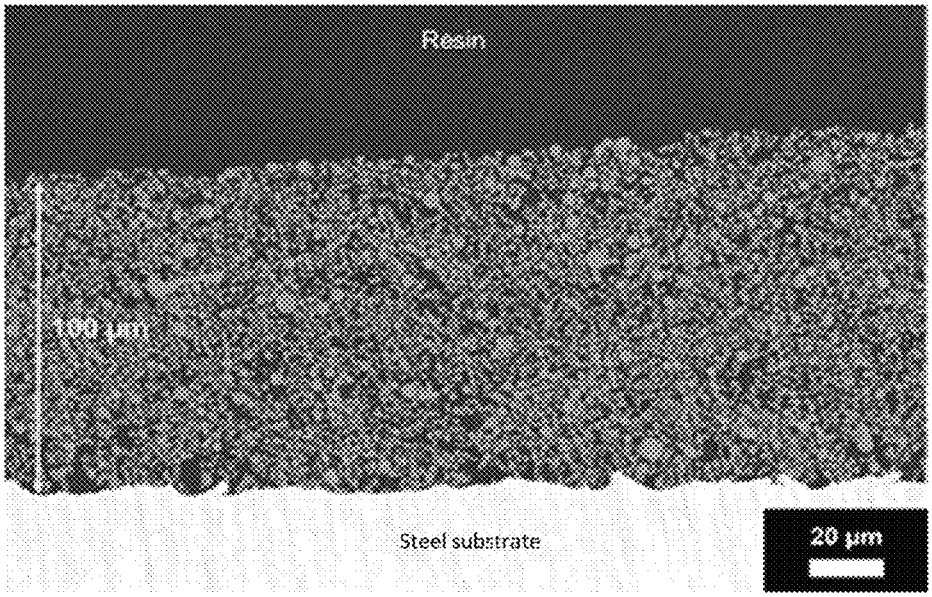

[Fig. 5]
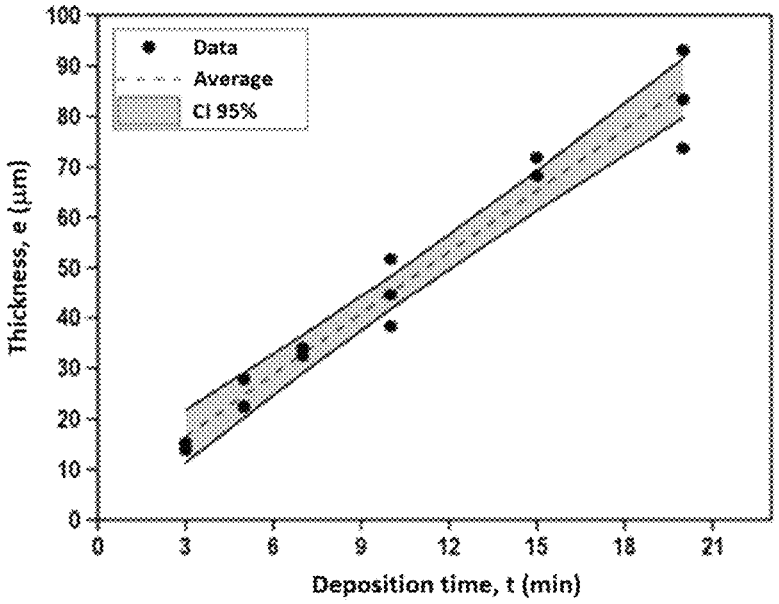
[Fig. 6]
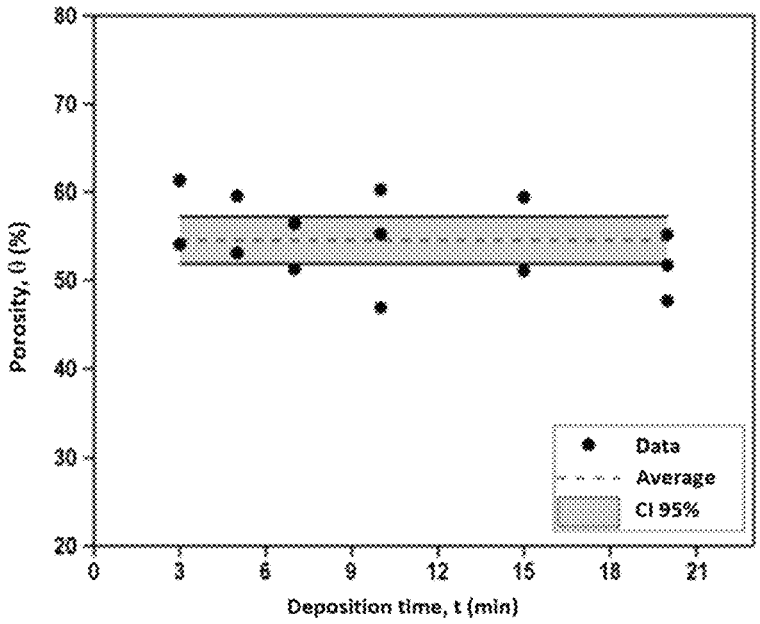

[Fig. 7]
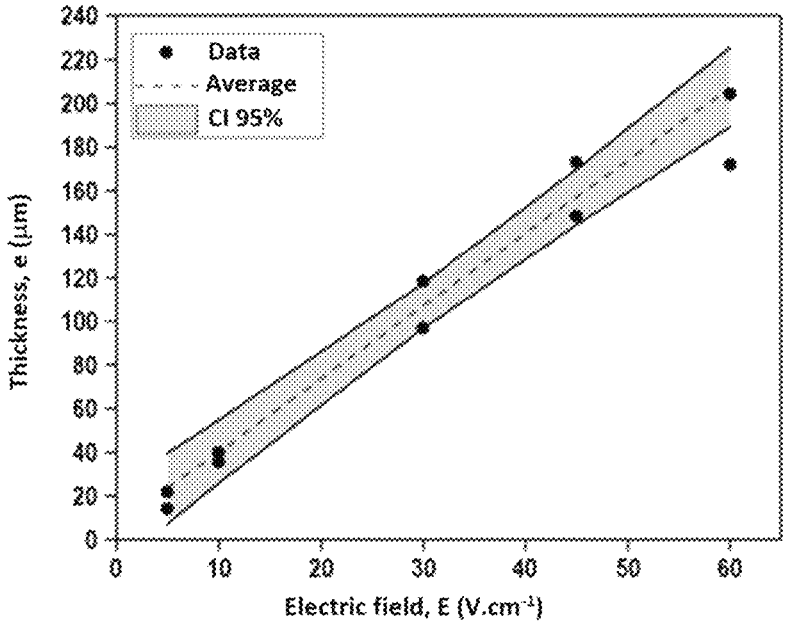
[Fig. 8]
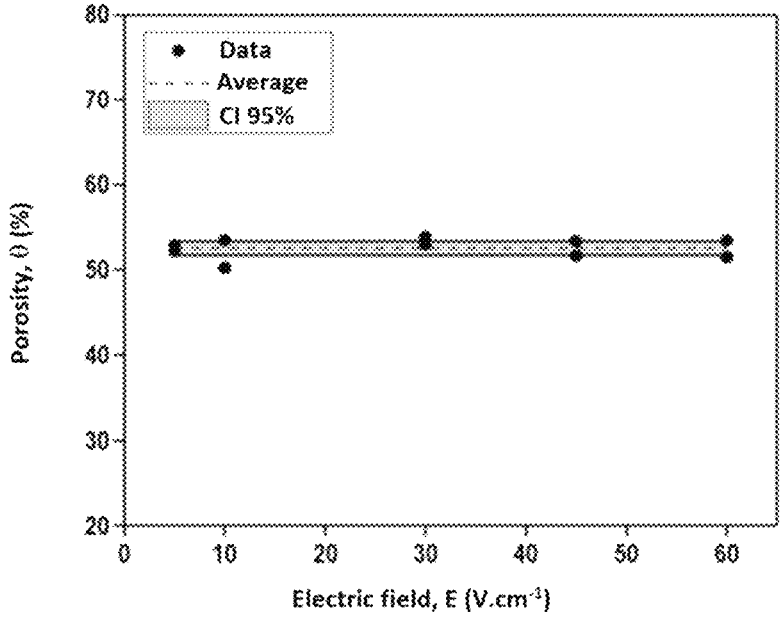

[Fig. 9]
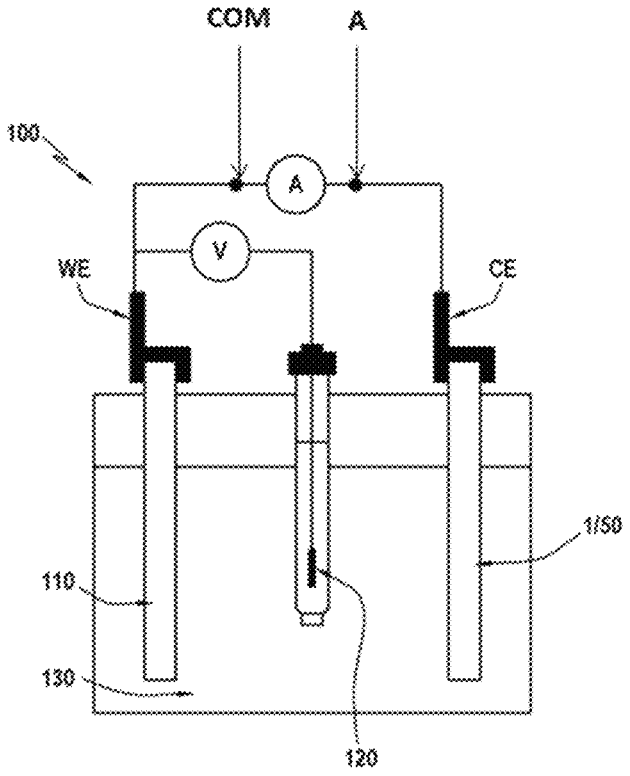
[Fig. 10]
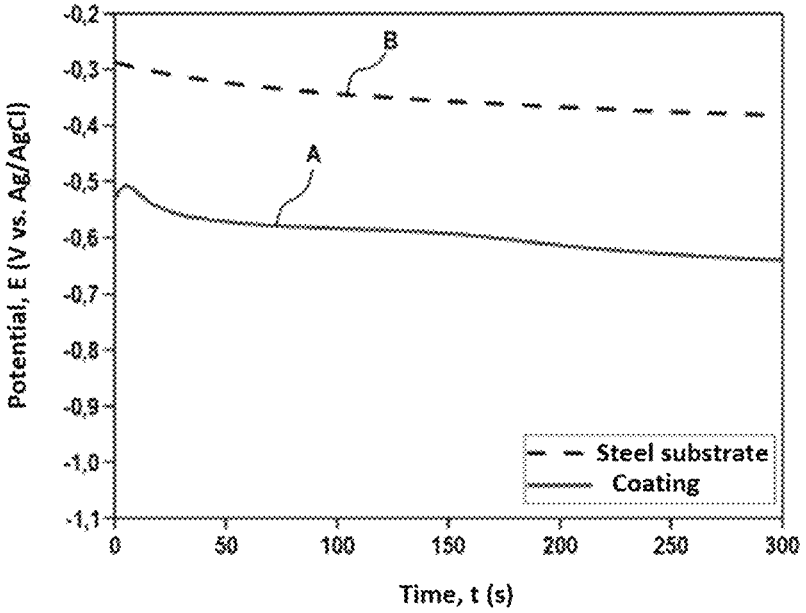

[Fig. 11]
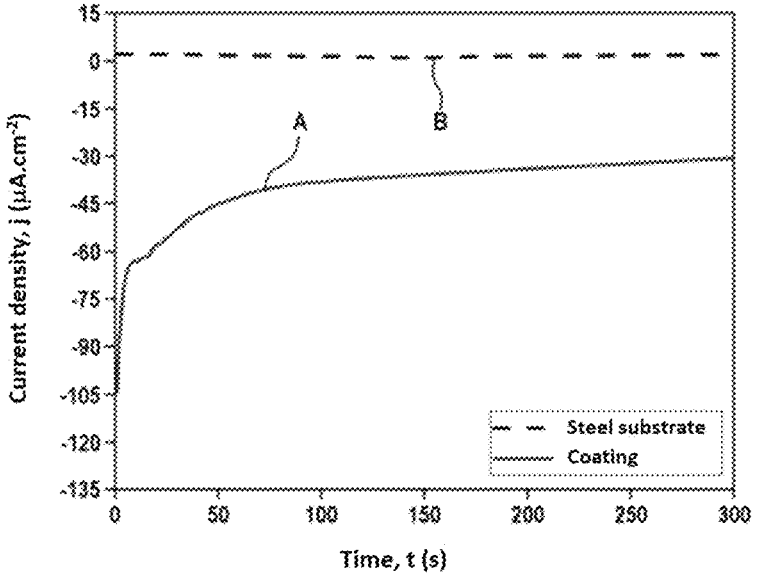
[Fig. 12]
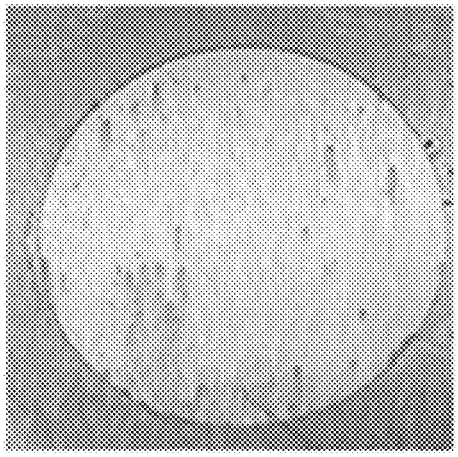

[Fig. 13]
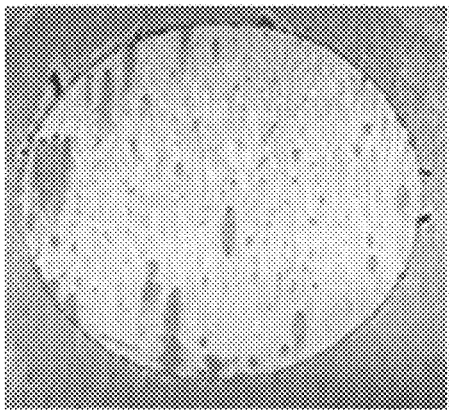
[Fig. 14]
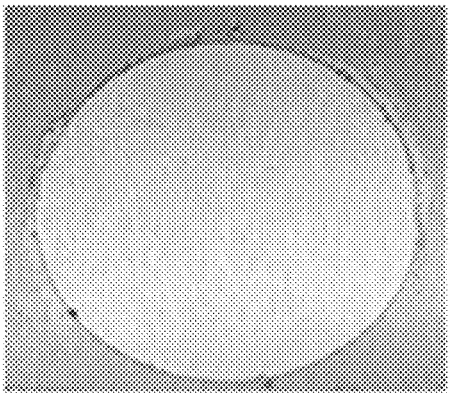
[Fig. 15]
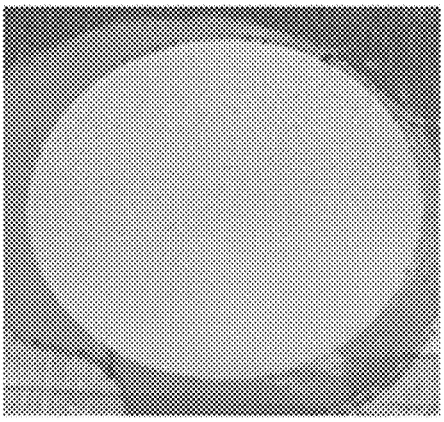

[Fig. 16]
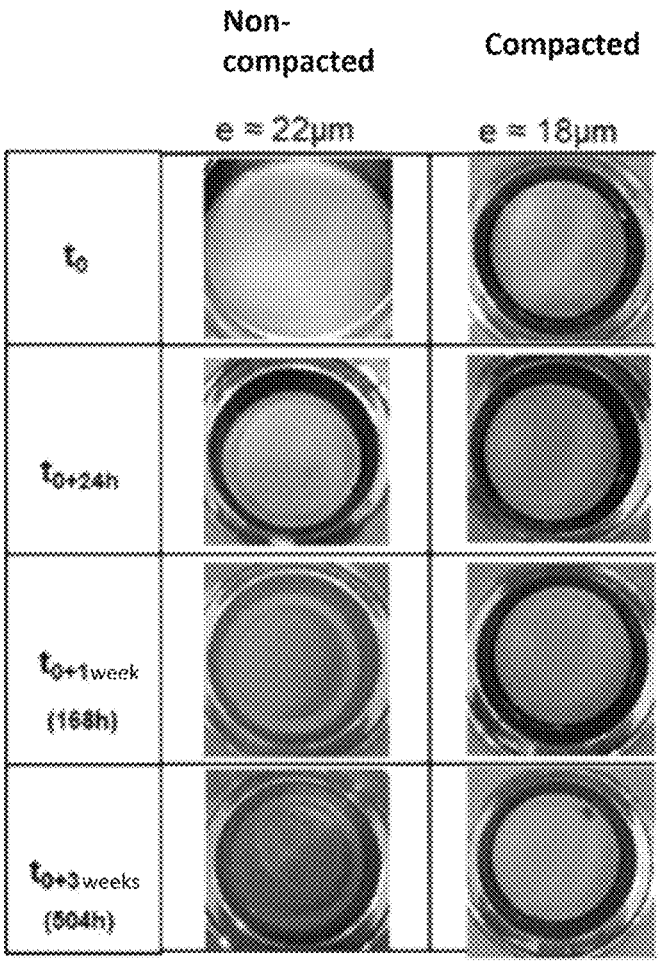

METHOD FOR FORMING A CATHODIC PROTECTION COATING ON A TURBOMACHINE PART

CROSS-REFERENCE TO RELATED APPLICATIONS

This application is the U.S. National Stage of PCT/FR2022/051997, filed Oct. 21, 2022, which in turn claims priority to French patent application number 2111343 filed Oct. 26, 2021. The content of these applications are incorporated herein by reference in their entireties.

TECHNICAL FIELD

The present invention relates to a method for forming a cathodic protection coating on a turbomachine part from an organic electrolyte. The invention is of interest, in particular, for the protection of compressor or turbine shafts used in aeronautical or industrial turbomachines.

PRIOR ART

Steels with a high mechanical strength, typically greater than 1000 MPa, such as Maraging 250 or ML340, 40CDV12 can be used to form turbomachine parts, such as compressor or turbine shafts. However, in use, these steels can be sensitive to corrosion.

In order to protect the parts from corrosion, it is known to coat them with anti-corrosion paints applied by manual or automatic spraying. With this type of method, controlling the thickness of applied paint can be relatively difficult, in particular if the part has a complex geometry. It is therefore possible to obtain coatings that do not comply with the technical definition of the part which may have reduced characteristics (corrosion resistance in the case of an under-thickness, adhesion in the case of overthickness).

Solutions have been proposed to try to resolve this problem of homogeneity of the deposit on complex parts. For this purpose, U.S. Pat. No. 3,787,305 proposes deposition, by electrophoresis, of cathodic protection particles made of aluminium with a resin that is generally acrylic. The deposition is carried out from an aqueous electrolyte in which the resin is dissolved and a voltage greater than that for electrolysis of water is applied, which leads to significant local variations in pH around the electrodes and consequently leads to the precipitation of the resin containing the particles of aluminium on the surface of the working electrode. As will be detailed below, the electrolysis of water presents various problems, which have been observed by the inventors during their work. In addition, the resin deposited is electrically insulating, which limits the thickness of deposit that can be obtained during a given deposition step by electrophoresis to around twenty micrometres, a value which may prove insufficient for entirely covering surface defects of the substrate or for ensuring sufficient corrosion protection. The method proceeds by a calcination of the organic resin using a heat treatment at a relatively high temperature, which can affect the microstructure of certain substrates and cause the appearance of additional pores in the coating. In addition, if a deposit of significant thickness is desired, in other words of thickness greater than or equal to 20 μm, it is necessary to repeat the sequence of deposition by electrophoresis and calcination of the resin, one or more times, after the calcination of the resin of the first layer. This significantly extends and complicates the method.

It is desirable to have a method for forming an anti-corrosion coating which overcomes the disadvantages of the prior art.

DISCLOSURE OF THE INVENTION

The invention relates to a method for forming a cathodic protection coating on a substrate forming a turbomachine part, comprising at least:

- deposition, on the substrate, of particles for cathodic protection of the substrate, this deposition being performed by electrophoresis from an organic electrolyte comprising at least said particles, and
- forming an inorganic matrix in pores of the deposit of particles produced in this way, comprising at least:
  - impregnating said deposit with an impregnation composition,
  - a drying heat treatment of the deposit impregnated by the impregnation composition, and
  - densifying the deposit by mechanical compacting, after the drying heat treatment, in order to make said deposit electrically conductive.

The electrophoresis technique enables a homogeneous deposit with a controlled thickness to be obtained compared to a gun spraying method, even on parts having complex shapes or large dimensions. The use of an organic electrolyte enables harmful effects linked to the electrolysis of water to be overcome. More specifically, the work performed by the inventors has shown that the electrolysis of water, which can occur during a deposition by electrophoresis from an aqueous electrolyte, can lead to hydrogen embrittlement of the part if the deposition electrode corresponds to the cathode made of steel (− sign) and to a bubbling phenomenon which affects the homogeneity of the deposit. Anodic deposition from an aqueous electrolyte may, for its part, require entering a base pH range, in order to obtain negatively charged particles, which can result in corrosion of the deposited particles. The invention also enables a large range of deposit thickness to be obtained, during a same stage of electrophoretic deposition. Such thicknesses can be more difficult to attain, in a single deposition, since the deposition is performed from an aqueous electrolyte by imposing a DC voltage. The inorganic matrix formed in the pores of the deposit constitutes a binding phase enabling the cathodic protection particles to be held on the substrate and to hold these particles together in order to ensure the cohesion of the deposit. The mechanical compacting of densification can bring the cathodic protection particles of the substrate into contact, in order to make the coating dense and electrically conductive. Through the compacting, the coating acquires high performance sacrificial properties for combating corrosion.

In an exemplary embodiment, the organic electrolyte comprises an alcoholic liquid medium in which the particles are in suspension.

Such a feature is advantageous in order to deposit an electrolyte having good environmental and health compatibility and a larger electroactivity range.

In particular, the alcoholic liquid medium can be formed with at least 50% by volume of propanol, for example propan-2-ol.

The use of propanol is advantageous, because it eliminates the need for a dispersant in the electrolyte, thus simplifying the method.

In an exemplary embodiment, a thickness of the deposit of cathodic protection particles on the substrate is greater than or equal to 40 μm.

The invention is particularly advantageous in this case, because it enables such thicknesses to be attained in a single electrophoretic deposition step, without having to interrupt the deposition.

In an exemplary embodiment, the cathodic protection particles are made of aluminium or aluminium alloy. The invention is, however, not limited to the use of such a material, and other examples will be described below.

In an exemplary embodiment, the substrate is made of steel.

As for the particles, the invention is not limited to a particular family of materials for the substrate, the latter being able to be more generally metallic, for example made of a metal alloy or even made of a composite material, provided that it has a sufficient electrical conductivity to enable the electrophoretic deposition.

In an exemplary embodiment, the impregnation composition comprises at least one alkali metal silicate or one alkaline earth metal silicate.

Such a feature is advantageous because it can avoid the use of an acid medium, which can be implemented, in particular, during a sol-gel deposition in order to avoid any risk of damaging certain substrates. The use of a sol-gel route for forming the inorganic matrix nevertheless remains within the scope of the invention and will be described below.

In an exemplary embodiment, the formation of the inorganic matrix comprises a stabilisation heat treatment of the deposit.

Such a feature advantageously makes it possible to evacuate the most possible liquid medium and to make the deposit insoluble in water.

It should be noted that it is possible to perform the drying heat treatment at a first temperature and then the stabilisation heat treatment at a second temperature greater than the first temperature. In this case, these two treatments are separate and carried out at different temperatures. According to an alternative, a single and same heat treatment can be performed in which the deposit is both dried and stabilised (the stabilisation and drying heat treatments being combined in this case). According to another alternative, there is no stabilisation treatment but only a drying heat treatment.

In particular, the stabilisation heat treatment can be performed before the densifying by mechanical compacting. However, it does not depart from the scope of the invention if the stabilisation heat treatment is performed after this densifying.

In particular, a temperature less than or equal to 500° C., for example less than or equal to 450° C., can be imposed during the drying heat treatment and the optional stabilisation heat treatment.

The fact of imposing a limited temperature during the heat treatment can avoid any risk of damage to the substrate due to exposure to too high a temperature.

In an exemplary embodiment, the substrate is a compressor shaft or a turbine shaft, for example made of high-strength steel.

BRIEF DESCRIPTION OF THE FIGURES

FIG. 1 is a partial schematic illustration of the electrophoretic deposition of cathodic protection particles on the substrate.

FIG. 2 is a partial schematic illustration of the substrate coated by these particles.

FIG. 3 is a partial schematic illustration of an example of forming an inorganic matrix in the pores of a deposit of particles, which can be implemented within the scope of the invention.

FIG. 4 is a photograph obtained by scanning electron microscopy in cross-section, of a deposit of cathodic protection particles.

FIG. 5 is a graph showing the change in thickness of the deposit of cathodic protection particles as a function of deposition time at constant electric field.

FIG. 6 is a graph showing the change in porosity of the deposit of cathodic protection particles as a function of deposition time at constant electric field.

FIG. 7 is a graph showing the change in thickness of the deposit of cathodic protection particles as a function of applied electric field at constant deposition time.

FIG. 8 is a graph showing the change in porosity of the deposit of cathodic protection particles as a function of the applied electric field at constant deposition time.

FIG. 9 is a partial schematic representation of a galvanic coupling assembly used to evaluate the cathodic protection provided by a coating obtained by implementation of an exemplary method according to invention.

FIG. 10 is a graph showing the change in galvanic coupling potential as a function of time.

FIG. 11 is a graph showing the change in galvanic coupling current density as a function of time.

FIG. 12 is a photograph of a sample following a galvanic coupling test.

FIG. 13 is a photograph of a sample following a galvanic coupling test.

FIG. 14 is a photograph of a sample following a galvanic coupling test.

FIG. 15 is a photograph of a sample following a galvanic coupling test.

FIG. 16 corresponds to a comparative test result showing the influence of compacting on corrosion resistance.

DESCRIPTION OF THE EMBODIMENTS

FIGS. 1 and 2 represent the deposition on the substrate 1 of cathodic protection particles 11 within the scope of an exemplary method according to the invention.

This deposition is performed by electrophoresis from an organic electrolyte 10, which comprises the particles 11 in suspension in an organic liquid medium. The particles 11 and the organic liquid medium can be of diverse compositions, as will be described below. The particles 11 may be the only particles in suspension in the organic liquid medium, but it does not depart from the scope of the invention when the electrolyte 10 also comprises additional particles, distinct from the particles 11, in suspension in the organic liquid medium. The additional particles can have an average size D50 less than the average size D50 of the particles 11. The additional particles can be present in minor quantities compared to the particles 11.

Advantageously, additional particles can be chosen which have limited hardness, so as to be deformed during the mechanical compacting and so as not to disturb this step. The additional particles can be metallic or ceramic. The substrate 1 to be coated is immersed in the organic electrolyte 10. The surface of the substrate 1 intended to be coated by the particles 11 may have been prepared beforehand in a conventional manner by a chemical and/or mechanical stripping. The surface of the substrate 1 comprises an electrically conductive material. The substrate 1 can be made of a metallic material, for example aluminium or aluminium alloy, or made of steel. It is also possible to use a substrate 1 made of composite material, provided its electrical conductivity is sufficient for performing the deposition of particles 11 by electrophoresis. The substrate 1 is a turbomachine part, for example a part from an aircraft turbine engine or industrial turbomachine. The substrate 1 may be a compressor shaft or a turbine shaft. The substrate 1 may be intended to be used at a temperature less than or equal to 1000° C., for example less than or equal to 500° C., depending on the material used for the substrate.

As illustrated in FIGS. 1 and 2, the substrate 1 consists of an electrode which is connected to a first terminal of an electric generator G. A counter-electrode 15 is present facing the surface of the substrate 1 to be coated and is also immersed in the electrolyte 10. The counter-electrode 15 is connected to a second terminal of the electric generator G, different from the first terminal. A stirring means (not shown) may be present in the electrolyte 10 in order to ensure mixing of this bath during the deposition. Due to the application of an electric field between the substrate 1 and the counter-electrode 15, the electrically charged particles 11 move and are deposited on the substrate 1 in order to obtain the deposit 6 of particles 11. The particles 11 can be deposited in contact with the substrate 1. In the illustrated example, the substrate 1 is negatively charged during the deposition and the particles 11 are positively charged. However, it does not depart from the scope of the invention if the substrate 1 is positively charged and the particles 11 are negatively charged.

The particles can have an average size D50 less than or equal to 30 μm, for example between 10 nm and 30 μm. Various forms of particles can be used. According to one example, the particles 11 have a shape factor substantially equal to 1, having for example a substantially spherical geometry. The particles 11 can be in solid form. The particles 11 can be metallic. The material of the particles 11 is chosen as a function of the material of the substrate 1 for cathodic protection thereof. Hence, the particles 11 constitute a sacrificial material which corrodes preferentially compared with the underlying substrate 1, in order to preserve it. The cathodic protection coating, obtained after the mechanical compacting is electrically conductive so as to allow electrical conduction between the coating and the substrate and to obtain this preferential corrosion of the cathodic protection particles 11. The material of the particles 11 is chosen so as to allow an oxidising/reducing pair with a standard potential strictly less than that formed by the material of the substrate 1. For example, for a substrate 1 made of steel, it is possible to use cathodic protection particles 11 made of aluminium or aluminium alloy, but it is also possible to use, for the same substrate 1, particles 11 made of zinc or zinc alloy, or of magnesium or magnesium alloy, for example.

The content by mass of particles 11 in the electrolyte 10, before the start of the deposition by electrophoresis, can be greater than or equal to 0.1%, for example between 0.1% and 20%.

The content by mass of organic liquid medium liquid medium in the electrolyte 10, before the start of the deposition by electrophoresis, can be greater than or equal to 75%, for example between 75% and 99.9%.

The organic liquid medium can be formed at least 50% by volume by an organic compound or a mixture of organic compounds. This organic compound or mixture of organic compounds can be present in the organic liquid medium in a content by volume greater than or equal to 75%, for example greater than or equal to 95%.

The organic liquid medium can be substantially free of water or have a limited water content enabling the deposition to be substantially unaffected by the phenomenon of electrolysis of water. The content by volume of water in the organic liquid medium can typically be less than or equal to 5%.

According to one example, the organic liquid medium is formed at least 50% by volume by alcohol or a mixture of alcohols. The alcohol or mixture of alcohols can be present in the organic liquid medium in a content by volume greater than or equal to 75%, for example greater than or equal to 95%. The alcohol or alcohols used can be $C_2$ or $C_3$ alcohols, being chosen from ethanol and propan-2-ol, for example. It should be noted that the organic liquid medium is not necessarily alcoholic, the medium being able, according to one example, to comprise acetone, or to be formed exclusively of acetone.

The organic liquid medium may include a dispersant. The dispersant can be a stearic, ionic or electrostearic dispersant. Among the iconic dispersants, it is possible to use metal salts, for example chlorides and nitrates such as, for example: $AlCl_3 \cdot 6(H_2O)$, $MgCl_2 \cdot 6(H_2O)$, $Mg(NO_3)_2 \cdot 6(H_2O)$ and $Al(NO_3)_3 \cdot 9(H_2O)$. The dispersant can be present in the organic liquid medium in a concentration greater than or equal to 0.1 $mmol \cdot L^{-1}$, for example between 0.1 $mmol \cdot L^{-1}$ and 2.5 $mmol \cdot L^{-1}$. Other salts can be envisaged; such as sulfates or phosphates. Other types of ionic dispersants are also possible, such as diiodide, the mixture of diiodide and acetone (see the publication: Journal of the European Ceramic Society (2011), vol. 31, pp. 1075-1086) or triethylamine (TEA). Electrostearic dispersants, such as polyelectrolytes, can be used, such as polyethylenimine or polyacrylic acid. As indicated above, the use of propanol in the electrolyte 10 is advantageous by making the use of dispersant superfluous.

The deposition of the particles 11 can be performed by imposing a DC or pulsed voltage. An electric field greater than or equal to 5 $V \cdot cm^{-1}$, for example between 5 $V \cdot cm^{-1}$ and 200 $V \cdot cm^{-1}$, or even between 5 $V \cdot cm^{-1}$ and 60 $V \cdot cm^{-1}$, can be imposed during the deposition.

According to an alternative, a DC or pulsed current can be applied during the deposition of the particles 11. A surface current density greater than or equal to 10 $nA \cdot cm^{-2}$, for example between 10 $nA \cdot cm^{-2}$ and 10 $mA \cdot cm^{-2}$, can be imposed during the deposition.

The deposition of the particles 11 on the substrate 1 can be performed during a period greater than or equal to 10 seconds, for example between 10 seconds and 1 hour.

The thickness e of the deposit 6 of the particles 11 on the substrate 1 can be greater than or equal to 1 μm, for example greater than or equal to 40 μm. This thickness e can typically be between 1 μm and 300 μm, for example between 40 μm and 300 μm. The porosity by volume of the deposit 6 of the particles 11 on the substrate 1 can be greater than or equal to 50%, for example between 50% and 60%. The thickness e and the porosity of the deposit 6 are controlled by the time and the voltage or current imposed during the electrophoretic deposition. The electrical parameters to be adopted are determined by a person skilled in the art as a function of the electrolyte 10 used.

The details relating to the step of electrophoretic deposition of the particles 11 have just been described. The following attempts to describe, in conjunction with FIG. 3, details relating to the formation of the inorganic matrix in the pores of the deposit 6.

An impregnation composition 20 is impregnated in the pores of the deposit 6 of particles 11 with a view to forming the inorganic matrix 40. The example illustrated in FIG. 3 illustrates an impregnation by a soak-and-withdraw technique. In this technique, the substrate 1 coated with the deposit 6 of particles 11 is connected to a movable device 30 enabling its immersion in a bath of impregnation composition 20 in order to perform the impregnation. In general, the impregnation composition 20 can be in liquid form. By way of illustration, the speed of withdrawal of the substrate 1 by the device 30 can be between 1 and 1000 $mm \cdot min^{-1}$. The viscosity of the impregnation composition 20 at 20° C. can be between 1 mPa·s and 500 mPa·s, for example between 1 mPa·s and 200 mPa·s. The viscosity is measured using a rheometer with a shear speed of 644 $s^{-1}$. A person skilled in the art will easily recognise that other impregnation methods are possible, such as impregnation by manual or automated spraying. The impregnation composition 20 can fill at least 50% of the volume of the pores of the deposit 6, for example at least 75% of this volume, or even substantially all of this volume.

The impregnation composition 20 can include at least one sol-gel precursor or an alkali metal silicate or alkaline earth metal silicate. The impregnation composition 20 can, for example, comprise sodium silicate $Na_2SiO_3$ or a calcium or magnesium silicate. The sol-gel precursor can be chosen from: silicon alkoxides, such as TEOS (tetraethoxysilane) and TMOS (tetramethoxysilane), sol-gel precursors comprising aluminium such as aluminium tri-sec-butanoate and aluminium triisopropylate or sol-gel precursors comprising zirconium such as zirconium tetrapropoxide. The impregnation composition 20, like the cathodic protection coating 50 to be obtained, can be free of phosphate, in particular aluminium phosphate. The impregnation composition 20, like the cathodic protection coating 50 to be obtained, can be free of chromium-based compounds with an oxidation state +VI. The impregnation composition 20, like the cathodic protection coating 50 to be obtained, can be free of chromate or lead compounds. These characteristics make it possible to conform with environmental regulations.

Once impregnation by the impregnation composition 20 has been performed, a heat treatment of the deposit 6 impregnated by the impregnation composition 20 can be carried out, in order to consolidate the deposit of cathodic protection particles impregnated by the impregnation composition and to stabilise this deposit. This heat treatment comprises at least one drying heat treatment enabling the deposit to be consolidated by evacuating the majority of the liquid medium present in the impregnation composition and retaining a solid part binding the particles 11. A temperature greater than or equal to 70° C., for example between 70° C. and 100° C., can be imposed during the drying heat treatment. The duration of the drying heat treatment can be greater than or equal to 1 hour, for example between 1 hour and 3 hours.

If desired, a stabilisation heat treatment can be performed to totally remove the liquid medium and obtain a protective coating that is insoluble in water. As indicated above, the drying and stabilisation can be performed during a common heat treatment, or a first drying heat treatment can be carried out followed by a second stabilisation heat treatment at a higher temperature. In the latter case, during the stabilisation heat treatment, a temperature greater than or equal to 250° C., or even between 250° C. and 500° C., can be applied.

The heat treatment (including the drying and optional stabilisation technique) can lead to a chemical transformation of the impregnation composition, for example to its polymerisation in the case of a sol-gel precursor. The chemical transformation of the impregnation composition undergone during the heat treatment can be distinct from a pyrolysis.

A temperature less than or equal to 500° C., for example less than or equal to 450° C., can generally be imposed during the heat treatment. A temperature greater than or equal to 200° C., for example between 200° C. and 500° C. or between 200° C. and 450° C. can generally be imposed during the heat treatment. The heat treatment can be performed over at least one hour, for example over at least ten hours. The heat treatment can be carried out under air.

After the drying heat treatment, compacting of the impregnated impregnation composition 20 can be performed in order to further densify the deposit of particles 11. This compacting can be carried out by project organic or inorganic particles, made for example of corundum, glass or sodium bicarbonate. Water-soluble particles can be projected in order to produce the compacting, made for example from sodium hydrogen carbonate. Document FR 3 102 694 describes a usable compacting technique.

An electrically conductive, cathodic protection coating 50 is obtained, which comprises an inorganic matrix 40 originating from the impregnation composition 20 which holds the particles 11 to one another and ensures their adhesion to the substrate 1. As indicated above, it does not depart from the scope of the invention if the compacting is performed after drying but before stabilisation.

EXAMPLES

Example 1: Obtaining a Covering Electrophoretic Deposition of Significant Thickness A deposit 6 of aluminium particles 11 was produced by electrophoresis on the surface of a substrate made of steel. The covered substrate can be seen in FIG. 4. The deposition was performed using an electrolyte 10 formed by a suspension of aluminium particles 11 in pure propan-2-ol without adding any additive. The deposition was performed for a duration of 10 minutes and while imposing an electric field of 30 $V \cdot cm^{-1}$. The deposit is covering, homogeneous and of significant thickness, in this case equal to 100 μm. The resin shown in FIG. 4 corresponds to an epoxy resin used for coating the sample in order to be able to observe the sample with a scanning electron microscope.

Example 2: Influence of Time on the Deposition of Cathodic Protection Particles A plurality of depositions of aluminium particles (10 g/L) in an electrolyte of pure propan-2-ol was performed by imposing a constant electric field of 10 $V \cdot cm^{-1}$ and by varying the deposition time between 3 minutes and 20 minutes.

The thickness of the deposit obtained varies from 15 μm to 90 μm as a function of the deposition time (FIG. 5). No reduction in the deposition rate is observable over this range of deposition times, which indicates that it would be possible to obtain higher thicknesses for longer deposition times. The only theoretical limit on thickness of the coatings would come from a depletion of particles in the suspension. No flaking of the deposit was observed up to thicknesses of approximately 200 μm. The measured porosities of the deposits are similar over the entire range of deposition times and are in a range from 50% to 60%, as shown in FIG. 6. The porosity is independent of the deposition time.

Example 3: Influence of Electric Field on the Deposition of Cathodic Protection Particles A plurality of depositions of aluminium particles in an electrolyte of pure propan-2-ol was performed, while imposing a deposition time of 10 minutes and by varying the applied electric field between 5 $V \cdot cm^{-1}$ and 60 $V \cdot cm^{-1}$. The results obtained are given in FIGS. 7 and 8. It is possible to produce an aluminium powder deposit by electrophoresis with a controlled thickness in the range from 5 μm to 220 μm (FIG. 7), while maintaining a similar microstructure, with a porosity varying from 50% to 60% (FIG. 8). The application of higher electric field values could enable higher thickness values to be obtained, able to be up to 500 μm.

Example 4: Demonstration of the Cathodic Protection Provided by the Coating Obtained by Implementing the Invention A deposit 6 of aluminium particles 11 on a substrate made of steel was obtained by imposing an electric field of 10 $V \cdot cm^{-1}$ for 10 minutes. The deposit was then impregnated with sodium silicate by soak-and-withdraw at a withdrawal rate of 300 $mm \cdot min^{-1}$, subjected to a heat treatment at 400° C. for 3 hours then densified by mechanical compacting by projecting sodium bicarbonate particles with a particle size between 100 μm and 300 μm at a relative pressure of 3 bar.

A galvanic coupling experiment was performed over a period of 5 minutes, in order to demonstrate that the coating thus obtained did indeed have cathodic protection with respect to the underlying steel substrate. The assembly 100 used is illustrated in FIG. 9. The coating 50 tested was electrically connected to a bare steel substrate 110 by means of a zero-resistance ammeter (ZRA). The current flowing between the two electrodes is measured and corresponds to the galvanic coupling current. The common potential taken by the electrodes is also measured and plotted as a function of time. As shown in FIG. 9, the working electrode WE is connected to the substrate made of bare 15CDV6 steel. The counter-electrode CE is either bare steel 1 (acting as reference) or the coating 50 (symbol 1/50 in FIG. 9 designating either the bare substrate 1 or the coating 50). The reference electrode 120 is an Ag/AgCl electrode. The electrode assembly was immersed in a bath 130 of 0.05 M sodium chloride. FIG. 9 also shows the terminals "COM" and "A" of the ammeter and their connection to the electrodes WE and CE.

As shown in FIG. 10, the common potential taken by the bare substrate connected to the coating 50 (curve "A") as a more cathodic potential than the substrate connected to the same bare substrate 1 (curve "B"). The more negative galvanic coupling potential shows that the cathodic protection is indeed effective. According to FIG. 11, the measured galvanic coupling current density stabilises at a value of −30 $\mu A \cdot cm^{-2}$ (curve "A") which shows that the coating 50 supplies electrons, by its oxidation, to the bare substrate 110 in order that it is cathodically polarised and therefore protected.

The images of various electrodes have been taken following the galvanic coupling experiment. When two substrates made of bare steel are identical and are connected to one another, no significant current is observable and the two substrates have marked corrosion pits following the test (FIGS. 12 and 13). In the case where the bare substrate is connected to the tested coating, no corrosion pit is visible on the steel following the galvanic coupling test (FIG. 14). The coating tested no longer presents marked degradation (FIG. 15).

Example 5: Effect of Mechanical Compacting

A deposit of aluminium particles was obtained on a substrate made of 15CDV6 steel, by electrophoresis from an electrolyte formed by a suspension of aluminium particles dispersed in propan-2-ol without the addition of an additive. The deposition was performed by imposing a series of pulsed voltage cycles, alternating between a zero potential difference and a potential difference of +10 V with a duty cycle of ⅙. The frequency of application of the pulses was equal to 1 Hz and the total duration of the treatment was 30 minutes.

The deposit was then impregnated by sodium silicate, by soaking and withdrawal at a withdrawal rate of 300 $mm \cdot min^{-1}$. The assembly is then subjected to a heat treatment at 400° C. for 3 hours, then densified by mechanical compacting by projecting sodium bicarbonate particles with particle size between 100 μm and 300 μm at a relative pressure of 3 bar. A reference deposition corresponding in every aspect to the previously described deposition, with the difference that the compacting has been omitted, was also carried out using the same procedure. The non-compacted deposit had a thickness of 22 μm and the compacted deposit had a thickness of 18 μm.

A corrosion test was carried out under the following conditions: immersion in a solution of water+0.05 M NaCl or 3 g/L of NaCl. The test tubes were continuously monitored with photographs taken at regular intervals.

The results obtained following this test are given in FIG. 16 in which the photographs relating to the reference coating, without compacting, are provided in the left-hand column and those relating to the compacted coating are provided in the right-hand column. Without compacting the coating acts as a barrier, however the inherent defects in the deposit leave access paths for corrosive products to reach the substrate and initiate corrosion of the steel substrate. Compacting makes it possible to densify the deposit by bringing the aluminium particles contained in the deposit into contact. The bringing of the aluminium particles into contact can ensure the formation of a dense conductive film and the aluminium acts as a sacrificial anode, thus improving corrosion resistance and slowing, as can be seen in FIG. 16, the appearance of corrosion pits.

The expression "between . . . and . . . " should be understood as including the limits.

The invention claimed is:

1. A method for forming a cathodic protection coating on a substrate forming a turbomachine part, comprising:

deposition, on the substrate, of particles for cathodic protection of the substrate, said deposition being performed by electrophoresis from an organic electrolyte comprising said particles in suspension in an organic liquid medium, the electrically charged particles moving and being deposited on the substrate in order to obtain the deposition of particles due to the application of an electric field between the substrate and a counter-electrode, and forming an inorganic matrix in pores of the deposit of particles thus produced, comprising:

impregnating said deposit with an impregnation composition, drying heat treatment of the deposit impregnated by the impregnation composition, and densifying the deposit by mechanical compacting, after the drying heat treatment, in order to make the deposit electrically conductive.

2. The method according to claim 1, wherein the organic electrolyte comprises an alcoholic liquid medium in which the particles are in suspension.

3. The method according to claim 2, wherein the alcoholic liquid medium is formed at least 50% by volume by propanol.

4. The method according to claim 1, wherein a thickness of the deposit of cathodic protection particles on the substrate is greater than or equal to 40 μm.

5. The method according to claim 1, wherein the cathodic protection particles are made of aluminium or aluminium alloy.

6. The method according to claim 1, wherein the substrate is made of steel.

7. The method according to claim 1, wherein the impregnation composition comprises at least one alkali metal silicate or alkaline earth metal silicate.

8. The method according to claim 1, wherein the formation of the inorganic matrix comprises a stabilisation heat treatment of the deposit, the drying heat treatment being performed at a first temperature then the stabilisation heat treatment being performed at a second temperature greater than the first temperature, or a single and same treatment step in which the deposit is both dried and stabilised being performed, the stabilising and drying heat treatments being combined in this case.

9. The method according to claim 8, wherein the stabilisation heat treatment is performed before the densifying by mechanical compacting.

10. The method according to claim 1, wherein a temperature less than or equal to 500° C. is imposed during the drying heat treatment and the optional stabilisation heat treatment.

11. The method according to claim 1, wherein the densifying by mechanical compacting of the deposit is carried out by projecting particles.

12. The method according to claim 1, wherein the substrate is a compressor shaft or a turbine shaft.

* * * * *